United States Patent [19]

Greenbaum

[11] 4,202,734

[45] May 13, 1980

[54] METHOD FOR PRODUCING CALCINED COKE PELLETS

[75] Inventor: Robert R. Greenbaum, Coopersburg, Pa.

[73] Assignee: Bethlehem Steel Corporation, Bethlehem, Pa.

[21] Appl. No.: 877,635

[22] Filed: Feb. 14, 1978

[51] Int. Cl.[2] ..... C10B 45/02; C10B 53/08; C10B 57/04

[52] U.S. Cl. ..... 201/6; 44/10 C; 44/10 K; 201/22; 201/24; 201/21; 201/29; 201/33

[58] Field of Search ..... 201/6, 21, 22, 5, 12, 201/23, 24, 28, 29, 33; 44/10 R, 10 H, 10 K, 10 C, 23; 75/42

[56] References Cited

U.S. PATENT DOCUMENTS

| | | | |
|---|---|---|---|
| 1,756,896 | 4/1930 | Wisner | 201/9 |
| 2,287,437 | 6/1942 | Lesher et al. | 202/9 |
| 2,560,357 | 7/1951 | Martin et al. | 201/22 X |
| 2,664,390 | 12/1953 | Pevere et al. . | |
| 3,018,227 | 1/1962 | Baum et al. | 201/23 X |
| 3,051,628 | 8/1962 | Gorin et al. | 201/5 |
| 3,185,635 | 5/1965 | Creglow | 201/6 X |
| 3,368,012 | 2/1968 | Erickson | 201/5 X |
| 3,560,346 | 2/1971 | Gunter | 201/6 |
| 3,671,401 | 6/1972 | Gorin | 201/6 X |
| 4,039,319 | 8/1977 | Schapiro | 44/10 C X |
| 4,100,031 | 7/1978 | Kiritani et al. | 201/24 X |
| 4,105,501 | 8/1978 | Suzuki et al. | 201/6 |
| 4,110,169 | 8/1978 | Suzuki et al. | 201/24 X |
| 4,133,718 | 1/1979 | Jaquay | 201/6 |

FOREIGN PATENT DOCUMENTS

| | | | |
|---|---|---|---|
| 516265 | 9/1955 | Canada | 201/6 |
| 51-75703 | 6/1976 | Japan | 201/24 |

*Primary Examiner*—Joseph Scovronek
*Assistant Examiner*—Roger F. Phillips
*Attorney, Agent, or Firm*—Joseph J. O'Keefe; Charles A. Wilkinson; John S. Simitz

[57] ABSTRACT

An improved method for producing calcined coke agglomerates having good stability including adjusting the fluidity of coals or blends of coals to within a range of 1300 DDPM and 3000 DDPM, mixing the coals or blends of coals with char and optionally topped tar in a rotating agglomerating drum and agglomerating the mixture at a temperature between 750° F. and 875° F. (399° C.and 468° C.) for a time to form partially coked green coal agglomerates generally spherical in shape and calcining the partially coked green coal agglomerates at a temperature between 1500° F. and 2000° F. (815° C. and 1093° C). The calcined coke agglomerates are characterized by having a stability of not less than 60%.

10 Claims, 1 Drawing Figure

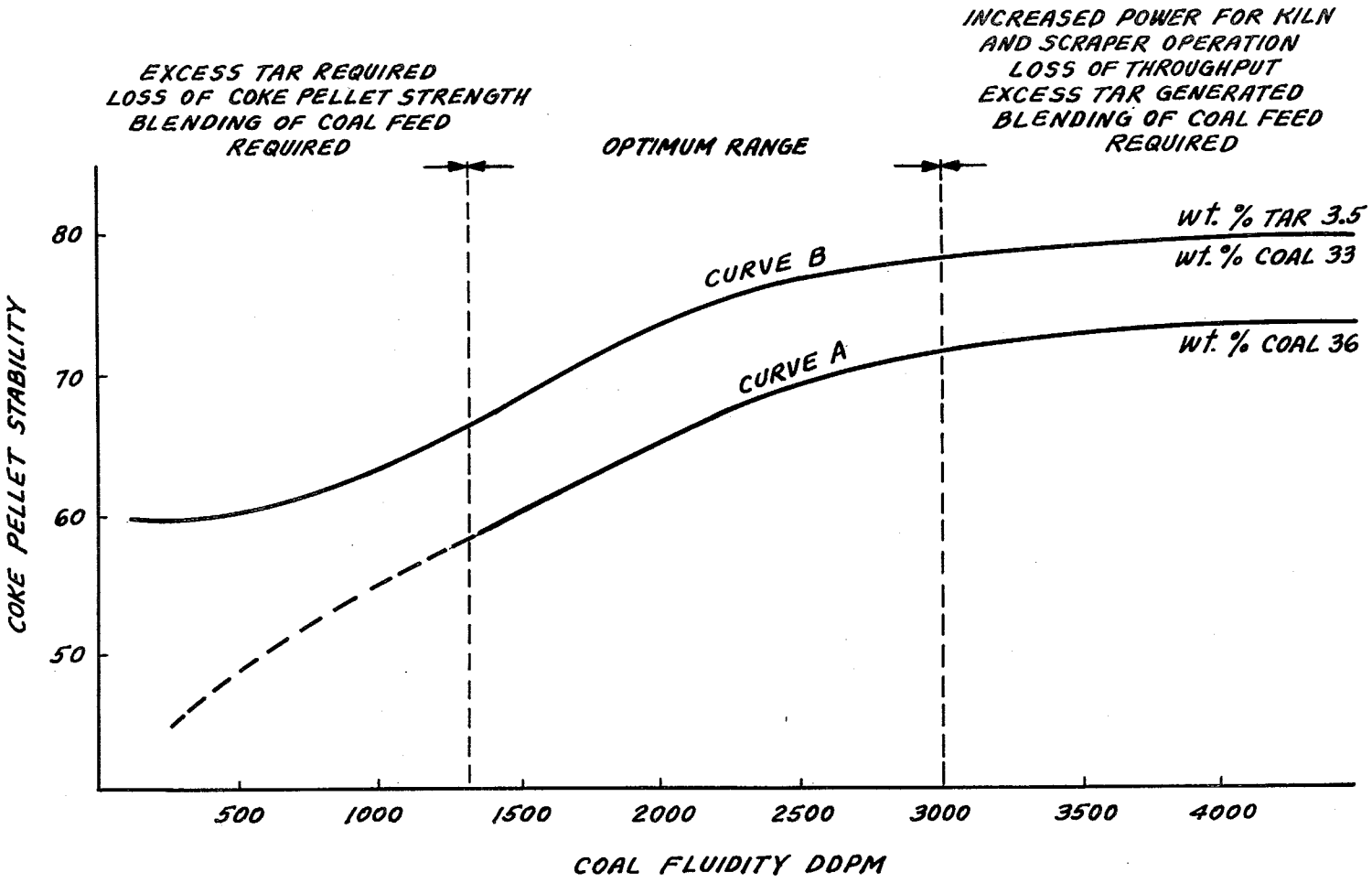
INCREASED POWER FOR KILN
AND SCRAPER OPERATION
LOSS OF THROUGHPUT
EXCESS TAR GENERATED
BLENDING OF COAL FEED
REQUIRED
wt. % TAR 3.5
wt. % COAL 33
wt. % COAL 36
OPTIMUM RANGE
CURVE B
CURVE A
EXCESS TAR REQUIRED
LOSS OF COKE PELLET STRENGTH
BLENDING OF COAL FEED
REQUIRED
COAL FLUIDITY DDPM
500
1000
1500
2000
2500
3000
3500
4000
COKE PELLET STABILITY
80
70
60
50

METHOD FOR PRODUCING CALCINED COKE PELLETS

BACKGROUND OF THE INVENTION

This invention is directed to an improved method for producing calcined coke agglomerates characterized by having good stability from caking, poorly caking and non-caking coals or blends of coals, char and optionally topped tar.

Reserves of good caking coals suitable for producing metallurgical grade coke are being depleted. Vast reserves of non-caking and poorly-caking coals are, however, available in this country. These reserves of coals are generally not usable in producing metallurgical grade coke in slot-type coke ovens.

In recent years, processes utilizing the non-caking coals and poorly-caking coals have been developed. Several processes are directed to mixing the coal with a binder and briquetting coal under pressure at a desired temperature. The coal briquettes thus formed are then calcined to elevated temperatures in either a one step process or a multi-step process to produce coke briquettes.

Other processes in which coal is agglomerated by mixing it with char, a solid distillation residue remaining after low temperature carbonization of coal, and a binder in a rotating drum and heating the mixture while being tumbled have been proposed. The agglomerates formed by the tumbling action are charged while hot into a vertical furnace to be calcined at elevated temperatures to produce coke agglomerates.

Caking coals when heated to temperatures of about 750° to 850° F. (399° to 454° C.) become fluid, that is, they become soft and plastic. Volatiale material in the coals is driven off and the coals fuse or agglomerate. After a time the coals resolidify and relatively hard coal agglomerates are discharged from the drum. Non-caking or poorly-caking coals are difficult, if not impossible, to soften and plasticize at any temperature. As a result, these coals are not readily agglomerated. In order to agglomerate these coals it is necessary to add large quantities of a binder to the coals. Throughput of these coals to produce product sized agglomerates is low and hence production is low. Then, too, calcined coke agglomerates made from these coals generally have poor stability. Caking coals, on the other hand, may be so fluid that when they become fluid they adhere to and build up as a scale deposit on the wall of the rotating drum. It is frequently necessary to use a scraper in the drum to prevent or reduce the size of the deposition of the scale on the wall. Scale deposits can become so great that the drum must be taken out of service so that the material adhering to the wall can be removed. Greater quantities of char than normal must be added to the coals in the drum to reduce the tendency of the coals to adhere to the wall. As a result, throughput of coals is reduced, production is reduced, and the process becomes economically unfeasible.

SUMMARY OF THE INVENTION

This invention is directed to an improved method for producing calcined coke agglomerates having good stability in which coals and blends of coals are mixed with char and optionally topped tar in a rotating agglomerating drum and remain in the drum for a time at a temperature to form partially coked green coal agglomerates. The partially coked green coal agglomerates are heated to a relatively high temperature in a furnace to produce calcined coke agglomerates. The use of the method of the invention standardizes the quantities of the materials charged to the rotating agglomerating drum, maximizes the throughput of coals with minimum formation of scale deposits on the wall of the drum.

The fluidity of the coals or blends of coals is adjusted to within a range of 1300 and 3000 DDPM. Prior to being charged into the rotating agglomerating drum, the coals or blends of coals are preheated to a temperature between about 550° F. and 650° F. (288° C. and 343° C.), the char is preheated to a temperature between 1100° F. and 1200° F. (593° C. and 648° C.) and the topped tar is preheated to a temperature between 575° F. and 625° F. (305° C. and 330° C.). The coals or blends of coals are heated by heat exchange with the char and after a period of time the temperature of the mix is stabilized between 750° F. and 900° F. (399° C. and 482° C.). While being heated, volatile matter is released from the coals or blends of coals. The volatile matter passes out of the rotating agglomerating drum and is collected to be reused when necessary as topped tar in subsequent agglomerations. The mix is agglomerated in the rotating agglomerating drum for a period of time sufficient to form generally spherical partially coked green coal agglomerates of a desired size, preferably between one inch and three inches in diameter. The partially coked green coal agglomerates are discharged from the drum and are placed in a furnace to be heated to a temperature between 1500° F. and 2000° F. (815° C. and 1093° C.) to produce calcined coke agglomerates having a stability of not less than 60%. The scale deposited on the wall of the rotating agglomerating drum is less than 10 weight percent of the solids charged to the rotating agglomerating drum.

By adjusting the fluidity of coals or blends of coals between 1300 and 3000 DDPM, the ratio of the materials charged into the rotating agglomerating drum are standardized between 35 and 43 weight percent of the coals or blends of coals, 61 and 53 weight percent of char and 4 weight percent of topped tar. If it is not necessary to add topped tar the ratio of coals or blends of coals to char is 35 and 43 weight percent to 65 and 57 weight percent respectively.

DRAWING OF THE INVENTION

The drawing of the invention is a graph which shows the expected stability of calcined coke agglomerates made from mixes of coals or blends of coals of varying fluidities, char and optionally topped tar.

PREFERRED EMBODIMENT OF THE INVENTION

We have found that calcined coke agglomerates having good stability can be made from coals or blends of coals, such as caking, poorly caking and non-caking coals. The method includes regulating the fluidity of the coals or blends of coals within specified limits, charging a predetermined standardized quantity of preheated coals or blends of coals and preheated char and optionally preheated topped tar into a rotating agglomerating drum. The materials remain in the drum at a temperature for a time sufficient to form generally spherical agglomerates of a desired size. The partially coked green coal agglomerates are discharged and charged into a calciner to be calcined at an elevated temperature to produce calcined coke agglomerates. The fluidity of coals or blends of coals is a relative measure of the plasticity of the coals or blends of coals and is determined by the Giessler Plastometer as described in ASTM D18/2-66 and D2639-67T, "Plastic Properties of Coal by the Giessler Plastometer". The fluidity of coals can also be measured by the Bethlehem Plastometer as described in "The Bethlehem Coal Plastometer: Its Description, Method of Operation and Precision", by A. F. Mantione. The fluidity of any coals or blends of coals is calculated as the dial divisions per minute (DDPM) with respect to temperature. The initial softening temperature of coals or blends of coals is that temperature at which a stirrer immersed in a sample of a coal makes a movement of one dial division a minute and the maximum fluid temperature is that temperature at which the dial movement reaches a maximum. The solidification temperature is the temperature at which the dial movement stops. In these specifications, the fluidity is described in dial divisions per minute as determined by the Bethlehem Coal Plastometer.

In the method of the invention, the fluidity of coals or blends of coals is determined. The fluidity is regulated to be within the range of 1300 to 3000 DDPM. The fluidity of coals can be regulated by well known means, such as oxidizing the coal wherein the coal is heated for a time at a low temperature. The fluidity of coals can also be regulated by blending coals, for example a low fluidity coal can be blended with a high fluidity coal in a weight proportion to produce the desired fluidity. In any event, the fluidity of the coals to be used in the production of calcined coke agglomerates is adjusted to within the desired range of 1300 to 3000 DDPM.

By using coals or blends of coals within the above desired range of fluidity, the quantities of raw materials to be charged into the rotating agglomerating drum for agglomeration can be standardized within specified limits. The amount of coals or blends of coals to be charged into the rotating agglomerating drum is between 35 and 43 weight percent of the total charge. The amount of char in the mix is between 57 and 65 weight percent of the total charge. If it is required to charge topped tar into the rotating agglomerating drum, the quantity charged is about 4 weight percent of the total charge. Of course when topped tar is charged the quantities of coals or blends of coals and char are adjusted accordingly. Topped tar is a product produced from the volatile matter driven off from the coal during agglomeration and generally constitutes about 4 to 6 weight percent of the materials in the rotating agglomerating drum.

It is necessary to supply heat to the materials in the rotating agglomerating drum for agglomerating purposes. The coals or blends of coals are preheated to a temperature between 550° F. and 650° F. (288° C. and 343° C.); the char is preheated to a temperature between 1100° F. and 1200° F. (593° C. and 648° C.) and when topped tar is charged, it is preheated to a temperature between 575° F. and 625° F. (305° C. and 330° C.) prior to being charged into the rotating agglomerating drum. The coals or blends of coals are heated by heat exchange with the char and after a time the temperature of the mix becomes stabilized between 750° F. and 900° C. (399° C. and 482° C.). The mix remains in the rotating agglomerating drum for a period of time, to allow the materials to be formed into generally spherical agglomerates within the size range of 1 inch and 3 inches when discharged from the rotating agglomerating drum. The resultant partially coked green coal agglomerates are at a temperature between 750° F. and 850° F. (399° C. and 454° C.) when discharged from the rotating agglomerating drum. The partially coked green coal agglomerates are charged into a calcining furnace for example, a vertical calcining furnace. The partially coked green coal agglomerates are heated to a temperature between 1500° F. and 2000° F. (815° C. and 1093° C.) and are held at temperature for a time, for example between two to four hours, to coke the green coal agglomerates. The calcined coke agglomerates discharged from the calciner are between 1 and 3 inches in size and have a stability of not less than 60%.

The stability or strength index of the calcined coke agglomerates is a measure of their resistance to degradation by impact and abrasion as determined by a tumbler test. The tumbler test consists of charging a known quantity, about 22 pounds, of agglomerates having a size consist between 1½ inches and ¾ inch in diameter into a steel drum which is 36 inches in diameter and 18 inches in length. The drum is rotated for 1400 revolutions. The drum has two steel angles, 2 inches by 2 inches by ¼ inch (50 mm by 50 mm by 6 mm) fastened longitudinally in the drum. The agglomerates are discharged from the drum and are screened. The weight percent of agglomerates which are retained on a $\mu$ inch size screen is taken as the stability or strength index of the agglomerates.

By adjusting the fluidity of the coals charged into the rotating agglomerating drum, the amount of scale deposited on the wall of the drum is reduced to not more than 10 weight percent of the solids charged into the drum, the throughput of materials is increased at no increase in power input required to run the rotating agglomerating drum or to operate scrapers to remove scale deposits from the wall of the rotating agglomerating drum. The amount of topped tar, if required, is between 2 and 8 weight percent of the total charge and the calcined coke agglomerates have a stability of not less than 60%.

Turning now to the drawing of the invention which is a graph showing the effect of coal fluidity upon the stability or strength index of calcined coke agglomerates, Curve A represents the relationship between coal fluidity and the stability of calcined coke agglomerates made from a mix containing coal and char. Curve B represents the relationship between coal fluidity and the stability of calcined coke agglomerates made from a mix containing coal, char and recycled topped tar. The stability of calcined coke agglomerates made from coal and char with topped tar additions as shown by Curve B is generally better than the stability of calcined coke agglomerates made from coal and char as shown by Curve A.

The portion of the curves bounded by the dashed vertical lines represents the range of optimum fluidity which the coal should have when charged into the rotating agglomerating drum. The range of optimum fluidity is about 1300 DDPM to 3000 DDPM. Within the optimum fluidity range, the stability of calcined coke agglomerates made from a mix of coals and blends of coals and char is between 58% and 72% while the stability of calcined coke agglomerates made from a mix of coal, char and 4% topped tar is about 67% to 78%.

As shown in the portions of the Curves A and B which are to the right of 3000 DDPM, the stability of the calcined coke agglomerates is high, however the increase in stability is more than offset by increased production costs due to early and frequent shutdowns of the rotating agglomerating drum for cleanup necessitated by scale deposits on the interior wall of the rotating agglomerating drum. Ordinarily, a scraper is provided to prevent undue scale deposits of coal. Coal which has a high fluidity readily adheres to the wall thereby necessitating increased power requirements to remove the adhering scale deposits. The quantity of scale deposits on the wall can become so great that it is necessary to shut down the rotating agglomerating drum to remove scale deposits from the wall. High fluidity coals also result in the formation of partially coked green coal agglomerates which are so large that they cannot be used as charge material in a blast furnace. The agglomerates are crushed and recycled in the system. There is, therefore, loss of production and increased operating costs.

High fluidity coals, that is, coals having a fluidity of more than 3000 DDPM, can be partially oxidized by heating them at a temperature within the ranges of 450° and 600° F. (232° C. and 315° C.) for a time in air. Partially oxidizing the coals can reduce their respective fluidities to within the desired range of 1300 to 3000 DDPM. However, oxidation can result in loss of stability in the calcined coke agglomerates and constitutes unnecessary use of high fluidity coals. Such coals can be blended with low fluidity coals to achieve the desired fluidity. It is well recognized that the partial oxidation of coal is time and temperature dependent and adjustments of either or both will accomplish the results desired.

High fluidity coals, that is, good caking coals, can be mixed with low fluidity coals, that is, non-caking or poorly caking coals, to make blends of coals which have a fluidity within the range specified. Utilization of coals in this manner increases the use of the coal reserves generally not used for coking purposes and also extends the life of coal reserves which are used to produce metallurgical grade coke. Thus, the depletion of the metallurgical grade coal reserves is delayed. It will be noted that the proportions of high fluidity coals and low or medium fluidity coals used in blending will vary dependent upon the relative fluidity of the coals and the desired final fluidity.

The agglomeration of coal or blends of coals and char can also be enhanced by the addition of topped tar to the mixture in the rotating agglomerating drum. Topped tar added to the coal during agglomeration will serve to increase the effective binding of the coals. Since topped tar is a by-product of the green coal agglomerating process, the recycling and use of topped tar as a portion of the mix in the rotating agglomerating drum reduces the cost of the process while increasing the strength of calcined coke agglomerates. We have found that the addition of about 4 weight percent of the total charge of topped tar to the mix in the rotating agglomerating drum does increase the operating temperature range of agglomeration. Generally, it is desired to heat the raw materials for agglomeration to a temperature within the range of 750° to 875° F. (399° to 468° C.). Agglomeration of coal at temperatures above 875° F. (468° C.). have resulted in the production of weakened calcined coke agglomerates. However, the addition of topped tar has increased the temperature range of forming partially coked green coal agglomerates to at least 900° F. (482° C.) while at the same time increasing the stability of calcined coke agglomerates.

In a specific example of the invention, Elkhorn-Hendrix coal, a low fluidity coal having a fluidity of 700 DDPM, char and topped tar were charged into an agglomerating drum having a diameter of 36 inches. The charge comprised 38 weight percent of coal preheated to a temperature of 600° F. (315° C.), 56 weight percent of char preheated to a temperature of 1170° F. (631° C.) and 6% topped tar preheated to a temperature of 575° F. (305° C.). The resultant mixture in the drum was 800° F. (426° C.) after 5 minutes of agglomerating time. The drum was rotated at about 18 revolutions per minute for 20 minutes. The green partially coked coal agglomerates were discharged from the drum at a temperature of 800° F. (426° C.) and placed in a calcining furnace. The agglomerates were heated to a temperature of 1700° F. (926° C.) at a rate of 350° F. per hour (121° C.) and were soaked at the temperature for two hours. The calcined coke agglomerates were cooled to ambient temperature and removed from the furnace. A nitrogen gas atmosphere was maintained in the furnace during the calcining and cooling cycle. The calcined coke agglomerates produced in this test has a stability between 60 and 65%. About 50% of the calcined coke agglomerates were within a size range of 1 to 3 inches.

In order to produce calcined coke agglomerates which were found to have minimal strength, required an addition of 6% topped tar which could exceed the balanced percent of recycled topped tar.

A high fluidity coal, Kayford coal having a fluidity of 3500 DDPM, char and topped tar was charged into the same agglomerating drum used above. The charge comprised of 37 weight percent coal preheated to 610° F. (321° C.), 59 weight percent preheated to 1200° F. (648° C.) and 4 weight percent topped tar preheated to 575° F. (305° C.). The mixture in the drum was at a temperature of 835° F. (446° C.) after being in the drum for 5 minutes. The mixture was treated as described above. The calcined coke agglomerates had an average stability index between 70 and 80 and 55% of the agglomerates were within a size range of 3 to 4 inches in diameter. However, scale deposits on the drum wall averaged about 20 weight percent of the solids charged into the drum.

The two coals, Elkhorn-Hendrix and Kayford were then mixed in a 1 to 1 ratio, that is the blend comprised 50 weight percent of each coal. The resultant fluidity of the blend was 1400 DDPM. The blend of coals, char and topped tar were fed into the same agglomerating drum. The charge comprised 40 weight percent of the blended coals preheated to 615° F. (324° C.), 56 weight percent of char preheated to 1180° F. (637° C.) and 4 weight percent topped tar preheated to 600° F. (315° C.). The temperature of the mix in the drum was 820° F. (438° C.) after 5 minutes of operation. The drum was operated for 15 minutes. The green partially coked agglomerates were calcined as described above. The calcined coke agglomerates were within a size range of 1 to 3 inches in diameter and had an average stability index of 70 to 75 percent. The scale deposited on the drum wall was less then 5 weight percent solids produced in the drum.

I claim:

1. An improved method for producing calcined coke agglomerates having a stability index of not less than 60 percent from coals and blends of coals comprising:

(a) adjusting the fluidity of the coals and blends of coals to between 1300 DDPM and 3000 DDPM, (b) charging a mix of the coals and blends of coals at a preheated temperature and char heated to a temperature higher than that of the coals and blends of coals into a rotating agglomerating drum, (c) heating the coals and blends of coals by heat exchange from the char while agglomerating the mix in the rotating drum to form partially coked green coal agglomerates, (d) discharging the partially coke green coal agglomerates from the rotating agglomerating drum, (e) charging the partially coked green coal agglomerates into a calcining furnace, and (f) heating the partially coked green coal agglomerates in the furnace for a time at a temperature to produce calcined coke agglomerates.

2. The method of claim 1 wherein the fluidity of the coal is adjusted in step (a) by heating the coal in air at a temperature for a time to partially oxidize the coal.

3. The method of claim 1 wherein the fluidity of the coal is adjusted in step (a) by blending a quantity of at least two coals of different fluidities to form a blend of coals having the desired fluidity.

4. The method of claim 1 wherein an amount of preheated topped tar is charged into the rotating agglomerating drum with the coals and blends of coals and char in step (b).

5. The method of claim 1 wherein the partially coked green coal agglomerates discharged from the agglomerating drum in step (d) are generally spherical in shape and about 50% of the agglomerates have a size of about one inch to three inches in diameter.

6. The method of claim 1 wherein the partially coked green coal agglomerates are heated to within a temperature range of 1500° F. to 2000° F. for about two hours to four hours in step (f).

7. A method for producing calcined coke agglomerates characterized by having a stability index of not less than 60 percent when tested by a modified tumbler test and a size within the range of one inch to three inches in diameter, said calcined coke agglomerates being made from a raw material mix containing coals and blends of coals, char and topped tar, which mix is agglomerated in a rotating agglomerating drum to form spherical-like partially coked green agglomerates at a temperature within the range of 750° F. to 900° F. (399° to 482° C.), the method comprising:

(a) adjusting the fluidity of the coals and blends of coals to between 1300 DDPM and 3000 DDPM, (b) charging the coals and blends of coals preheated to a temperature between 550° F. and 650° F. (288° C. and 347° C.), char preheated to a temperature between 1100° F. and 1200° F. (593° C. and 648° C.), and topped tar preheated to a temperature between 575° F. and 625° F. (305° C. and 330° C.) into said rotating agglomerating drum to form a mix containing between 36 and 39 weight percent coals or blends of coals, 60 and 57 weight percent char and about 2 to 6 weight percent topped tar, (c) retaining the mix of step (b) in the agglomerating drum for a time at a temperature to form partially coked green coal agglomerates, (d) discharging the partially coked green coal agglomerates from the rotating agglomerating drum, (e) charging the partially coked green coal agglomerates into a calciner, (f) heating the partially coked green coal agglomerates to a temperature between 1500° and 2000° F. (815° to 1093° C.) in the calciner for a time to calcine the green coal agglomerates, (g) cooling the calcined coke agglomerates, and (h) discharging the calcined coke agglomerates from the calciner.

8. The process of claim 7 in which the fluidity of the coal in step (a) is adjusted by preheating the coal at a temperature within the range of about 450° to 600° F. (232° to 315° C.) for a time to partially oxidize the coal prior to charging into the rotating drum.

9. The process of claim 7 in which the fluidity of the coal in step (a) is adjusted by blending portions of weakly caking or non-caking coals and a good caking coal.

10. The process of claim 7 in which the partially coked green coal agglomerates are heated within a temperature range between about 1500° F. and 2000° F. for between about two to four hours in step (f).

* * * * *

UNITED STATES PATENT AND TRADEMARK OFFICE

CERTIFICATE OF CORRECTION

PATENT NO. : 4,202,734

DATED : May 13, 1980

INVENTOR(S) : Robert R. Greenbaum

It is certified that error appears in the above—identified patent and that said Letters Patent is hereby corrected as shown below:

Column 4, line 26, "u inch" should read -- 3/4 --.

Signed and Sealed this

*Twelfth* Day of *August 1980*

[SEAL]

*Attest:*

SIDNEY A. DIAMOND

*Attesting Officer*

*Commissioner of Patents and Trademark*